US007827860B2

(12) United States Patent
Weis

(10) Patent No.: US 7,827,860 B2
(45) Date of Patent: Nov. 9, 2010

(54) MOBILE PUMP TESTING APPARATUS

(75) Inventor: Gary L. Weis, Salina, KS (US)

(73) Assignee: Weis Fire & Safety Equip. Co., Inc., Salina, KS (US)

( * ) Notice: Subject to any disclaimer, the term of this patent is extended or adjusted under 35 U.S.C. 154(b) by 38 days.

(21) Appl. No.: 12/420,657

(22) Filed: Apr. 8, 2009

(65) Prior Publication Data

US 2009/0255331 A1 Oct. 15, 2009

Related U.S. Application Data

(60) Provisional application No. 61/043,829, filed on Apr. 10, 2008.

(51) Int. Cl.
*G01M 19/00* (2006.01)

(52) U.S. Cl. ..... 73/168

(58) Field of Classification Search ..... 73/168
See application file for complete search history.

(56) References Cited

U.S. PATENT DOCUMENTS 6,386,049 B1 * 5/2002 Schrumm ..... 73/861.66
7,017,406 B1 * 3/2006 Cressman ..... 73/168

OTHER PUBLICATIONS

"Mobile Fire Pump Tester Uncovers Maintenance Issues," Fire Apparatus & Emergency Equipment, vol. XII, No. 6, Jun. 2008.
"Mobile Fire Pump Testing, Draft Commander," product brochure of Weis Fire & Safety Equipment Co., Inc., 2008.

* cited by examiner

*Primary Examiner*—Hezron Williams
*Assistant Examiner*—Nathaniel Kolb
(74) *Attorney, Agent, or Firm*—Jeffrey L. Thompson; Thompson & Thompson, P.A.

(57) ABSTRACT

A pump testing apparatus includes a tank mounted on a mobile trailer for testing water pumps associated with fire fighting equipment. Two rotatable draft tubes extend into the tank for drawing water from the lower part of the tank through suction hoses connected to the pump being tested. Two inlet manifolds receive water discharged from the pump being tested and direct the water into respective flow stations that measure the water flow rate. The water is then dispersed back into the tank. The tank has a system of baffles to prevent cavitation of the water circulating through the tank. A cooling system is provided to cool the water within the tank to maintain a desired water temperature during pump testing. The cooling system includes a supply line having a cool water inlet for connecting to a source of cool water, and cool water outlets at spaced locations throughout the tank.

27 Claims, 6 Drawing Sheets

Fig. 3
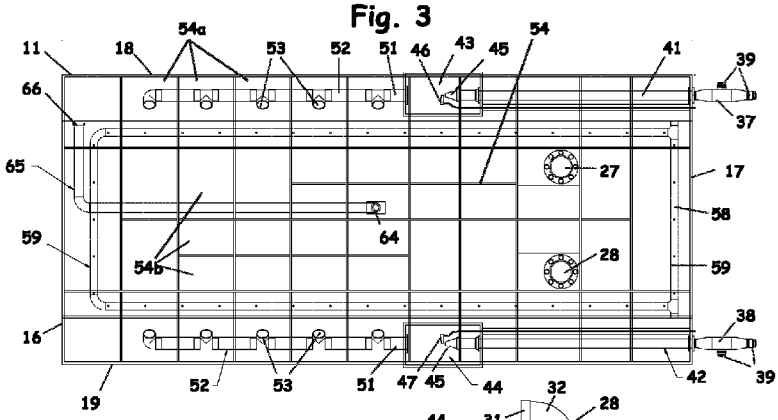
Fig. 5
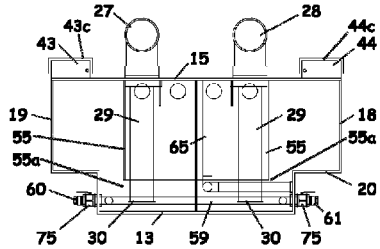
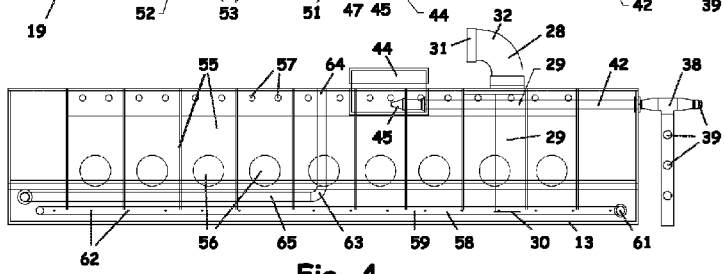
Fig. 4
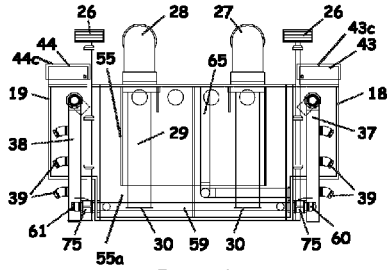
Fig. 6

MOBILE PUMP TESTING APPARATUS

RELATED APPLICATIONS

This application claims priority of the Applicant's U.S. Provisional Patent Application No. 61/043,829 filed on Apr. 10, 2008. The entire content of the Applicant's provisional application is incorporated herein by reference.

BACKGROUND OF THE INVENTION

1. Field of the Invention

The present invention relates generally to pump testing equipment and procedures. In particular, the present invention relates to a mobile pump testing apparatus that can be used to test water pump performance on fire fighting equipment and the like.

2. Description of the Related Art

Fire fighting equipment, such as fire trucks, are typically equipped with one or more onboard pumps capable of drawing water from a water source and pumping the water under high pressure through fire hoses for spraying onto fires. The water source for the pumps can be a pond, river, swimming pool, fire hydrant, or other available water supplies that can be drawn into the pump at a high flow rate (e.g., 500 to 2,500 gpm).

Standardized testing procedures have been developed for testing pumps used with fire fighting equipment to determine whether the pumps perform at their rated capacities. For example, the National Fire Protection Association has developed a recommended standard pump testing procedure, referred to as NFPA 1911 (2007 ed.), for testing water pumps associated with fire fighting equipment. The testing procedure requires a pump to be tested at various flow rates for predetermined lengths of time, which results in vast quantities of water to be pumped through the equipment. Fire hydrants alone are generally not capable of supplying fresh water at the high flow rates necessary for the length of time necessary to conduct the pumping tests.

Various methods have been employed in the past to supply water for the pump tests. For example, a pump test can be performed near a swimming pool so that water can be drawn out of the pool by the pump and then discharged back into the pool as the test is run. The use of a swimming pool to conduct the pump test can reduce water waste. However, swimming pools are often not available for use by a fire department or have water temperatures that exceed the maximum water temperature allowed by standard pump testing procedures.

Pump tests are also sometimes performed near a source of surface water, such as a pond, lake, or river, so that water can be drawn out of the water source at a first location and then discharged back into the water source at another location (e.g., downstream) as the test is run. Although this method can reduce water waste, it has other problems. For example, available surface water typically contains a high amount of sediment, algae, and other contaminants that result in frequent screen plugging and can deteriorate pump performance over time. The availability and temperature of surface water near a location where a test is to be conducted can also be problematic.

Large tanks have also been used to conduct pump testing procedures. The suction hose(s) for the pump being tested can be inserted into the tank to draw water to the pump, and the discharge line(s) from the pump can be arranged to discharge back into the tank. This technique allows the test water to be circulated during the pump testing procedures. However, the circulating water in the tank between the suction hose(s) and the discharge line(s) often cavitates and/or warms to a temperature exceeding the maximum allowed water temperature, thereby reducing the reliability of the test results.

There is a need for an improved apparatus and method for testing pumps associated with fire fighting equipment to overcome the problems with the prior art described above.

SUMMARY OF THE INVENTION

An object of the present invention is to provide a mobile fire apparatus test laboratory that can be used to perform a pump test according to the published test standard, NFPA-1911 (2007 ed.).

Another object of the present invention is to provide a pump testing apparatus that can be used to perform tests for pumps having a rated pumping capacity in a range of 500 to 3,000 gallons per minute.

A still further object of the present invention is to provide a pump testing apparatus that conserves water during testing procedures, and allows a true fire pump test to be performed from draft using clean, clear and cool water.

A still further object of the present invention is to provide an apparatus that can be used as a training device for training operators of fire fighting equipment on the proper use of their pumping equipment.

Additional objects of the present invention are to provide a pump testing apparatus that does not suffer from frequent screen plugging, that minimizes expensive downtime, that allows the apparatus to be disconnected quickly in the case of emergency, that can be used to help extend the reliability and efficiency of fire fighting equipment, that can be used to train operators of fire fighting equipment, and that helps ensure that the fire fighting equipment is ready for the next call to protect life and property.

To accomplish these and other objects of the present invention, a pump testing apparatus is provided for testing water pumps associated with fire fighting equipment and for training operators of the fire fighting equipment. The testing apparatus includes a large tank filled with water and carried on a mobile trailer. Two rotatable draft tubes extend into the tank for drawing water from the lower part of the tank through suction hoses connected to the pump being tested. Two inlet manifolds receive water discharged from the pump being tested and direct the water into respective flow stations that measure the water flow rate. The water is dispersed from the flow stations back into the tank through a diffuser manifold. The tank has a system of baffles to prevent cavitation of the water, which circulates at a high rate of speed through the tank. A cooling system is provided to cool the water within the tank to maintain a required water temperature during pump testing. The cooling system includes a supply line having a cool water inlet for connecting to a source of cool water, and cool water outlets at spaced locations around the outer perimeter at the lower part of the tank.

According to a broad aspect of the present invention, a pump testing apparatus is provided, comprising: a tank; at least one tank outlet associated with the tank for drawing a test fluid out of the tank for pumping by a pump being tested; at least one tank inlet associated with the tank for receiving the test fluid pumped by the pump being tested; and a baffle system in the tank for removing cavitations from the test fluid circulating within the tank between the tank inlet and the tank outlet during pump testing. A cooling system is also provided to cool the test fluid to maintain a desired fluid temperature of the test fluid during pump testing.

According to another broad aspect of the present invention, a method is provided for testing a pump associated with fire fighting equipment. The method includes providing a tank containing a supply of water; connecting at least one suction hose between the fire fighting equipment and a draft tube that extends into a lower part of the tank; connecting at least one discharge line between the fire fighting equipment and an inlet manifold associated with the tank; operating the pump to draw water from the lower part of the tank through the suction hose and to discharge water back into the tank through the inlet manifold; and measuring a flow rate of water passing through the inlet manifold into the tank. The method also includes using a baffle system to deflect the water circulating in the tank between the inlet manifold and the draft tube to prevent cavitation; and cooling the water in the tank while operating the pump to maintain a desired water temperature during a testing procedure.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings:

FIG. 3 is a partially cutaway plan view of the mobile pump testing apparatus of the present invention.

FIG. 4 is a partially cutaway side view of the pump testing apparatus.

FIG. 5 is a partially cutaway front view of the pump testing apparatus.

FIG. 6 is a partially cutaway rear view of the pump testing apparatus.

DETAILED DESCRIPTION OF THE INVENTION

Figure 1:
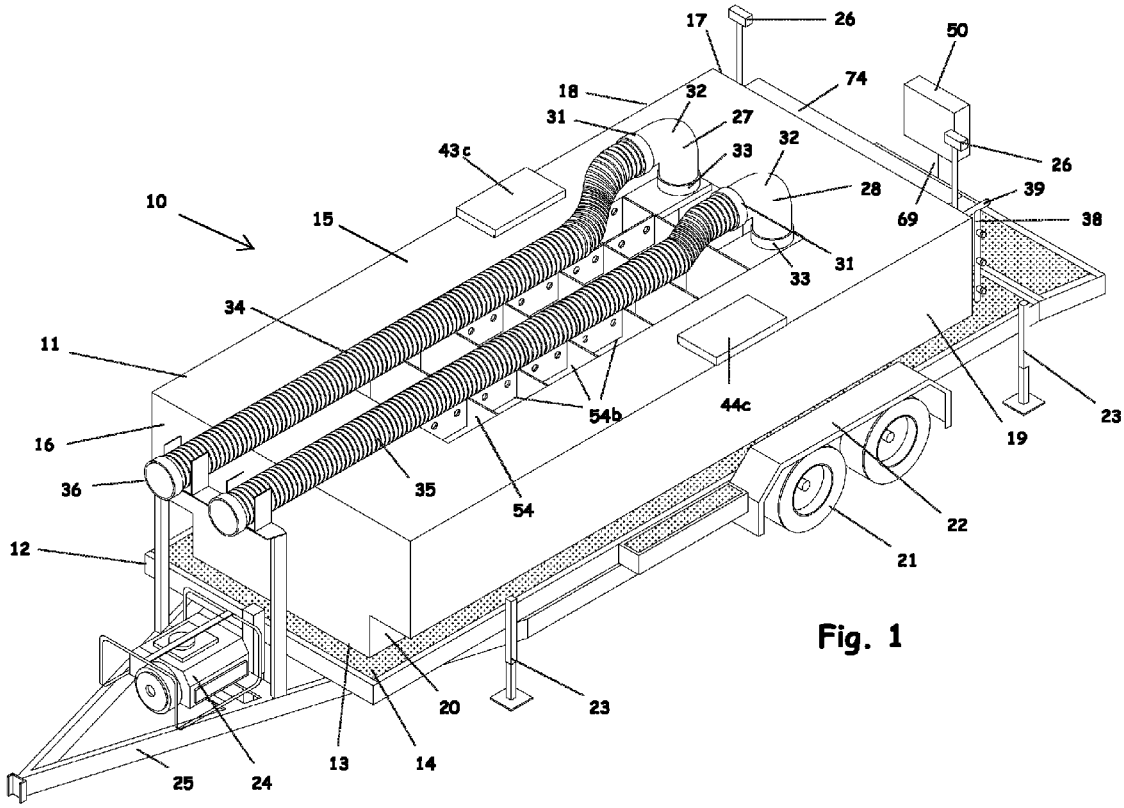
FIG. 1 is a front perspective view of a mobile pump testing apparatus according to the present invention.
Figure 2:
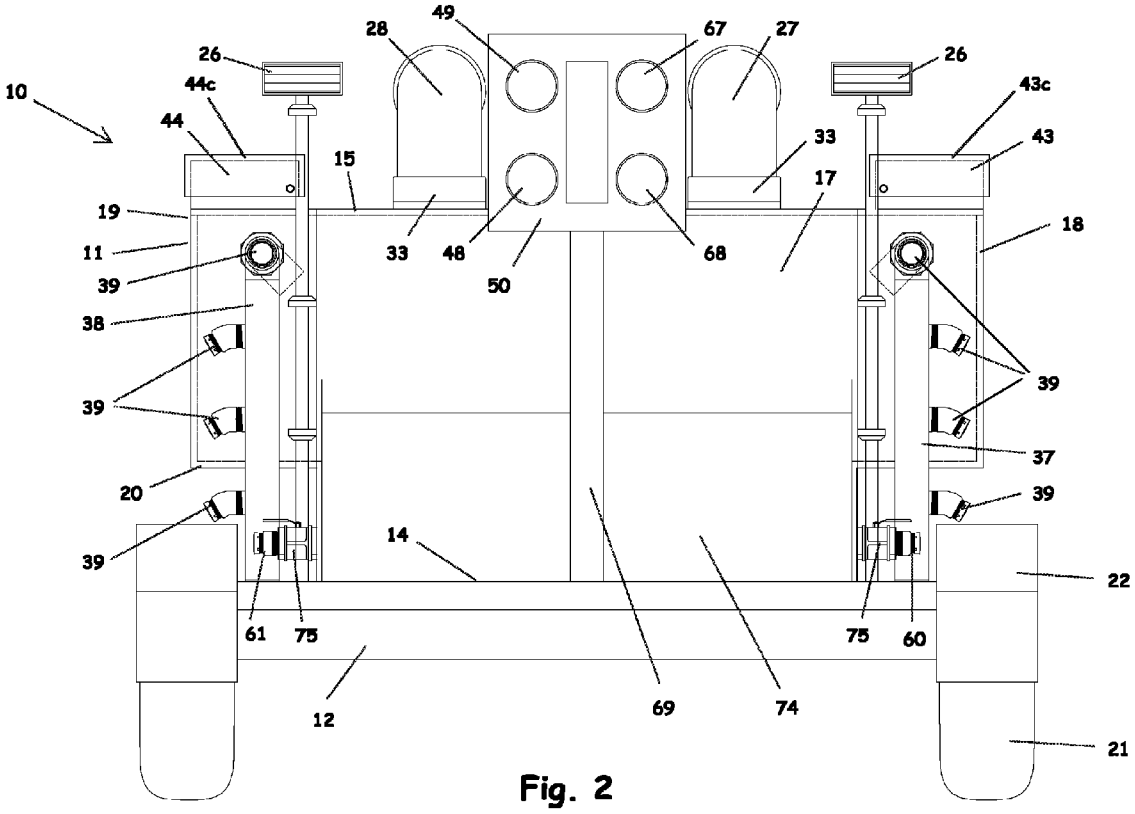
FIG. 2 is a rear view of the mobile pump testing apparatus shown in FIG. 1.
Figure 7:
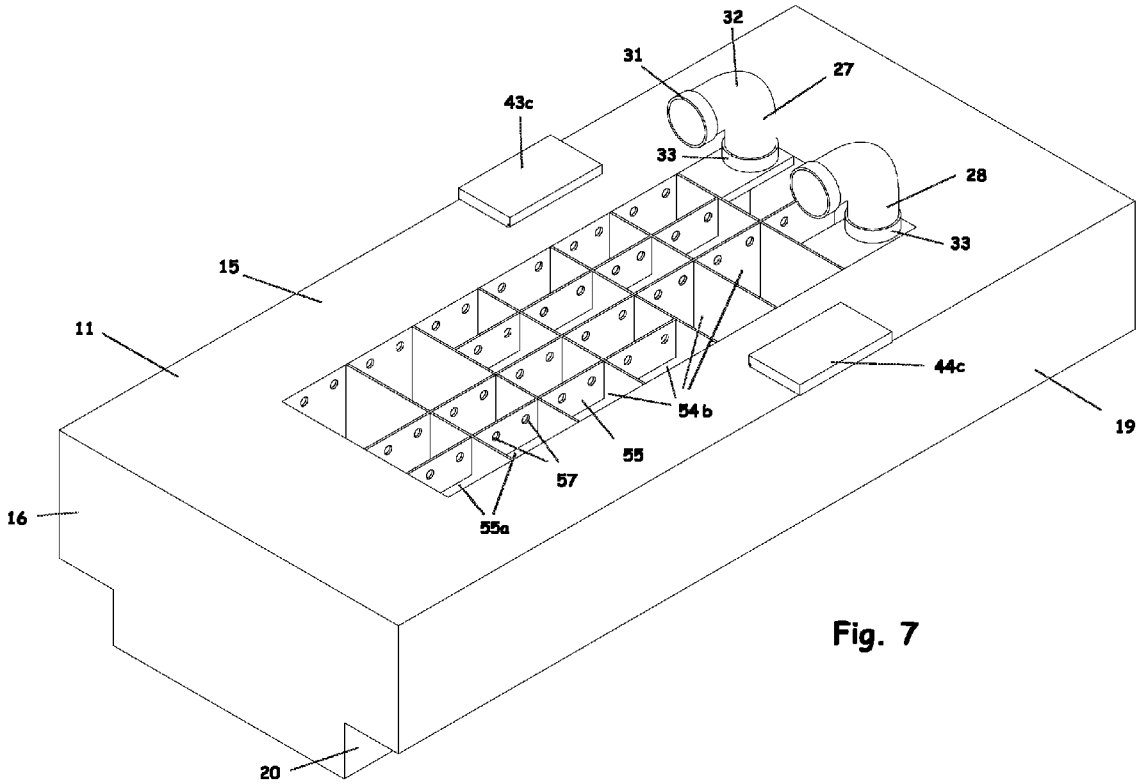
FIG. 7 is a partially cutaway perspective view of a tank of the pump testing apparatus.
Figure 8:
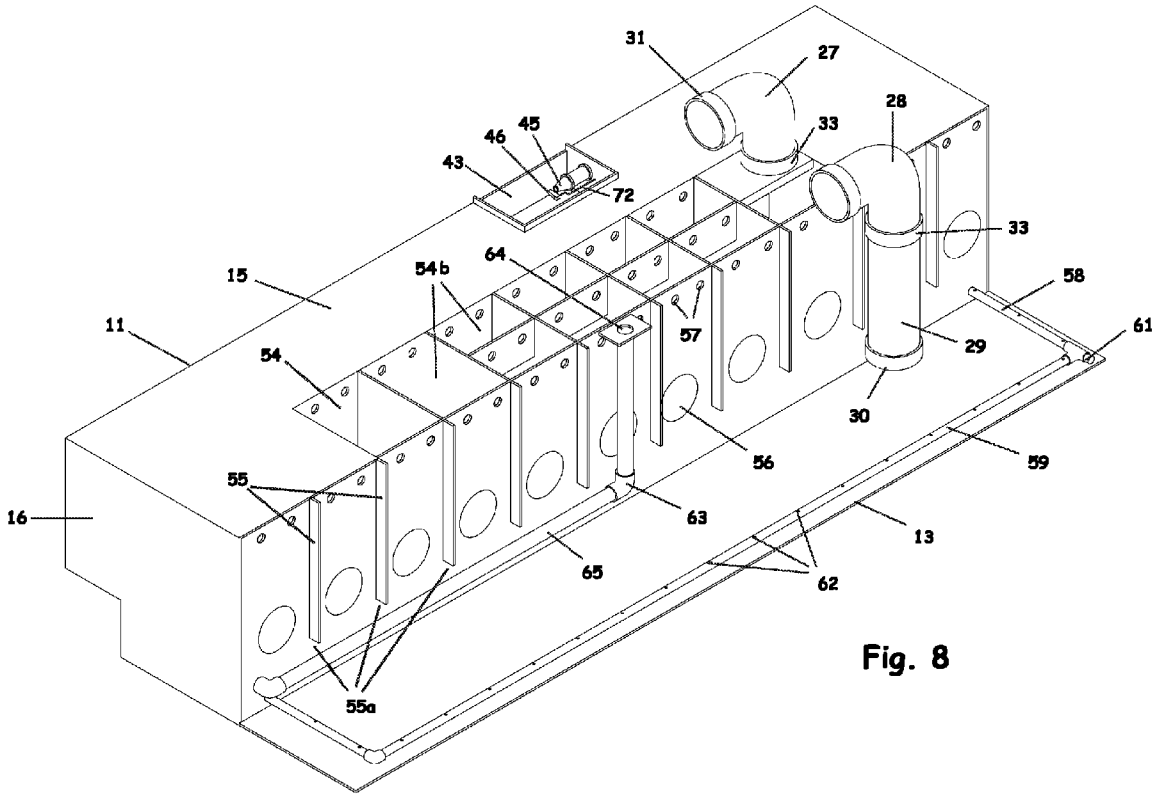
FIG. 8 is another partially cutaway perspective view of the tank of the pump testing apparatus.

A mobile pump testing apparatus according to the present invention will now be described in detail with reference to FIGS. 1 to 9 of the accompanying drawings.

The pump testing apparatus 10 is designed to be used as a mobile laboratory for testing pumps P used in fire fighting equipment T. However, the testing apparatus 10 may have other applications that will occur to those skilled in the art. For example, the testing apparatus 10 could be used for testing pumps used to pump fluids other than water, or for testing pumps used to pump water that are not used in fire fighting equipment. The testing apparatus 10 can also be used as a training device for training operators of fire fighting equipment in the proper use of their equipment. This application is intended to cover all such applications of the invention.

The pump testing apparatus 10 includes a large tank 11 mounted on a heavy duty tandem axle trailer 12. The tank 11 includes a flat bottom 13 that rests on the trailer bed 14, a top side 15, a front end 16, a rear end 17, and right and left sides 18, 19. Recessed areas 20 are provided on the left and right sides to accommodate the wheels 21 and fenders 22 of the trailer 12. The tank 11 can be made, for example, of a strong lightweight poly material having ¾ inch thick sides and ends and a 1 inch thick bottom. In one example embodiment, the tank 11 has a capacity of approximately 3,000 gallons.

The trailer 12 has stabilizer jacks 23 at its corners to support and stabilize the apparatus 10 when the tank 11 is filled with water during testing procedures. A generator 24 is mounted on the tongue 25 of the trailer 12 to provide a convenient source of electricity for use at remote testing locations. Flood lights 26 are mounted on the rear of the trailer 12 and can be powered, for example, by the electricity from the generator 24. The flood lights 26 provide light for illuminating the work area during nighttime use of the apparatus 10.

Two draft tubes 27, 28 pass through the top side 15 of the tank 11 and have vertical portions 29 that extend to a lower part of the tank 11. The draft tubes 27, 28 are preferably arranged to draw water from locations near the rear end of the tank 11. The vertical portions 29 of the draft tubes 27, 28 have open lower ends 30 near the bottom 13 of the tank 11 for drawing water out of the lower part of the tank 11 at two different spaced apart locations. The draft tubes 27, 28 each have a horizontal portion 31 connected to the vertical portion 29 by a 90 degree elbow structure 32. The draft tubes 27, 28 provide first and second tank outlets for drawing water out of the tank 11 during a pump testing procedure. The draft line provided by the draft tubes 27, 28 has only one 90 degree bend, thereby minimizing line pressure loss during testing procedures.

The draft tubes 27, 28 are rotatable 360 degrees about the central axes of the respective vertical portions 29 to change the direction of the horizontal portions 31 relative to the tank 11. The draft tubes 27, 28 can be made with a built-in swivel connection 33 between the elbow structures 32 and the vertical portions 29 to accomplish the 360 degree rotation, or the vertical portions 29 can be rotatable within the tank 11 together with the horizontal portions 31. By rotating the draft tubes 27, 28, the equipment to be tested can be located on the right side, the left side, or at the rear of the pump testing apparatus 10, thereby reducing set up time and making vehicle placement easy.

Suction hoses 34, 35 are connected to each of the horizontal portions 31 of the draft tubes 27, 28. Each suction hose 34, 35 has an end coupling 36 of a standard size to connect to the suction hoses of typical fire fighting equipment. Various adapters can be carried on the trailer 12 to accommodate different suction inlet sizes and connector styles. The suction hoses 34, 35 are flexible to facilitate various connection configurations, but are constructed to withstand high suction forces during use.

First and second inlet manifolds 37, 38 are provided at the right and left rear sides of the apparatus 10. The inlet manifolds 37, 38 can be made of stainless steel or other suitable materials that resist corrosion. Each inlet manifold 37, 38 has a plurality of inlet ports 39 for connecting with a plurality of discharge lines 40 from the pump P of the fire fighting equipment T. The inlet manifolds 37, 38 are arranged to combine the water from a plurality of pump discharge lines 40 for common discharge of the water into the tank 11. In the illustrated embodiment, each inlet manifold 37, 38 has four inlet ports 39, although it should be understood that fewer or more inlet ports can be used and still accomplish the objectives of the invention. A single inlet manifold 37 can be used to perform pump tests on smaller pumps (e.g., 500 to 1,500 gpm), while both inlet manifolds 37, 38 can be used to perform pump tests on larger pumps (e.g., exceeding 1,500 gpm). The inlet ports 39 on the inlet manifolds 37, 38 that are not used during a testing procedure are capped or closed with a valve to keep water from spilling out of the apparatus 10.

The inlet manifolds 37, 38 discharge water into main water lines 41, 42 that lead to first and second flow stations 43, 44 within the tank 11. A restriction nozzle tip 45 is located on the end of each main water line 41, 42. The nozzle tips 45 are smooth bore nozzles that can be removed and interchanged with other nozzle tips to provide the proper line pressure and output flow for the particular test to be performed. For example, the restriction nozzle tips 45 can have open bore diameters ranging in size from about 1.0 to 2.5 inches.

The flow stations 43, 44 each have a flow measuring device 46, 47 for measuring an output of the pump being tested. The flow measuring devices 46, 47 can be, for example, pitot meters, which determine the water flow rate in a known manner. The pitot readings from the devices 46, 47 are transferred to respective pitot gauges 48, 49 on the central monitoring station 50, as described below. Removable covers are provided over the flow stations 43, 44 to prevent water overflow and spillage during operation.

A discharge line 51 is associated with each flow station 43, 44 for discharging water from the flow station 43, 44 back into the tank 11. Each discharge line 51 has a diffuser manifold 52 with multiple openings 53 spaced throughout the tank 11 for diffusing the water as it reenters the tank 11. In the illustrated embodiment, each of the discharge lines 51 comprises a four inch diameter tube with five discharge openings 53 that discharge the water into a first group of internal compartments 54*a* of the tank 11, as further described below.

The tank 11 is divided into a plurality of internal compartments 54*a*, 54*b* to provide a baffle system 54 for the water flowing through the tank 11. A first group of the internal compartments 54*a* are arranged around the outer area of the tank 11, and a second group of the internal compartments 54*b* are arranged in a middle area of the tank 11. The compartments 54*a* around the outer area of the tank 11 have their tops completely covered by the top side 15 of the tank 11 to reduce water spilling out of the tank during transport and during testing procedures. The compartments 54*b* in the middle area of the tank 11 have their tops open to allow air to vent to the atmosphere. A screen type net covers the middle area of the tank to let the air vent from the compartments 54*b*, while also serving as protection to keep unwanted items out of the water, such as leaves or other debris that would tend to plug an inlet screen on a pump apparatus being tested.

A portion of the first group of compartments 54*a* are arranged directly in front of the flow stations 43, 44 for receiving water from the discharge openings 53 of the discharge lines 51. The rest of the compartments 54*a*, 54*b* receive water flowing through the tank 11 through openings that allow water to pass freely between the compartments 54*a*, 54*b*.

The compartments 54*a*, 54*b* are rectangular prism-shaped compartments defined within the tank by vertical inner walls 55 that extend between a lower portion of the tank 11 and the top of the compartments 54*a*, 54*b*. The lower ends of the vertical walls 55 are spaced (e.g., five inches) from the bottom 13 of the tank to provide openings 55*a* that allow water to move freely below and between the compartments 54*a*, 54*b* in the lower area of the tank 11. The openings 55*a* allow water flow in a longitudinal and/or a lateral direction through the tank between the adjacent compartments 54*a*, 54*b*.

A plurality of relatively large openings 56 (e.g., 10 inch diameter openings) are also provided in the vertical walls 55 between the compartments 54*a*, 54*b* in the lower part of the tank 11 to allow water to move freely between the compartments 54*a*, 54*b*. The large openings 56 allow water flow in a lateral and/or longitudinal direction through the tank between the adjacent compartments 54*a*, 54*b*. In the illustrated embodiment, the large openings 56 provide a lateral flow of water between the compartments, while the openings 55*a* provide both a longitudinal and a lateral flow of water between the compartments. This arrangement creates a baffling effect on the water flowing through the tank 11 because the water is required to change directions multiple times between locations where the water is discharged into the tank 11 by the discharge openings 53 and locations where the water is drawn back out of the tank 11 by the draft tubes 27, 28.

Relatively small openings 57 are provided between adjacent compartments 54*a*, 54*b* in the upper part of the tank 11. The small openings 57 are formed in the upper part of the vertical walls 55 and provide air discharge vents near the tops of the covered compartments 54*a*. The small openings 57 allow the water to change depth within the covered compartments 54*a* while the air is purged out of the compartments 54*a* into the atmosphere. The small openings 57 also allow water to flow between the upper part of the tank 11 when the tank 11 is full or nearly full.

During a pump testing procedure, water circulates within the tank 11 at a very high rate of speed between the discharge openings 53 of the diffuser manifold 52 and the open lower ends 30 of the draft tubes 27, 28. The baffle system 54 created by the compartments 54*a*, 54*b* functions to deflect the water circulating within the tank to reduce or prevent cavitations in the water, which can cause inaccurate readings of the flow rate and pressure and in some cases can cause the tested apparatus to surge during the testing procedure. The baffle system 54 prevents air swirls, moves air out into the atmosphere, and prevents air from entering the draft tubes 27, 28, which can cause the pumps being tested to lose their prime or otherwise perform poorly. The openings 55*a*, 56, 57 between the compartments 54 control the movement of water into and between each of the compartments 54 to maintain a desired water level and depth for the draft tubes 27, 28.

A cooling system 58 is provided for cooling the water in the tank 11 to maintain a desired water temperature during pump testing procedures. In the illustrated embodiment, the cooling system 58 uses a supply of fresh water (e.g., from a hydrant or a tanker) to cool the water circulating within the tank 11.

The cooling system 58 in the illustrated embodiment includes a supply line 59 that extends around an outer perimeter within the deepest part of the tank 11. The supply line 59 is connected to a cool water inlet port or ports 60, 61 for connecting to a source of cool water, such as a hydrant H or a tanker, using a connection hose 62*h*. For example, cool water inlet ports 60, 61 can be provided on the left and right sides of the tank 11, either of which can be used to supply cool water into the supply line 59. The supply line 59 has a plurality of cool water outlets 62 at spaced locations throughout the tank for introducing the cool water into the tank 11. The cool water outlets 62 are located in a lower part of the tank 11 so that the cool water mixes with the other water in the tank 11 in a lower part of the tank 11.

An overflow system 63 is connected to an upper part of the tank 11 for purging warm water from the tank 11 as fresh cool water is introduced into the lower part of the tank 11 by the cooling system 58. The overflow system 63 has a water inlet 64 located near the middle of the upper part of the tank 11. A discharge line 65 carries the purged water from the water inlet 64 to a discharge port 66 on a lower side of the tank 11.

The cooling system 58 can also include an onboard heat exchanger or cooling tower 58T (FIG. 10) to remove excess heat from the circulating water during pump testing procedures. The cooling tower 58T uses a cooling cycle, such as an evaporative cooling cycle, to reduce or maintain the temperature of the water within the tank 11. The cooling tower 58T can be used to minimize the amount of fresh water required to keep the tank water cool during testing procedures. The cooling tower 58T can be connected, for example, with an inlet 58*i* that draws water from an upper portion of the tank 11 (e.g., near the discharge port 66 of the overflow system 63), and an outlet 58*o* that discharges water into one of the inlet ports 61 of the cooling system 58. The cooling tower 58T will allow the system to maintain a substantially closed loop operation that recycles its own cooling water, instead of continuously purging the warm water from the tank 11.

Figure 9:
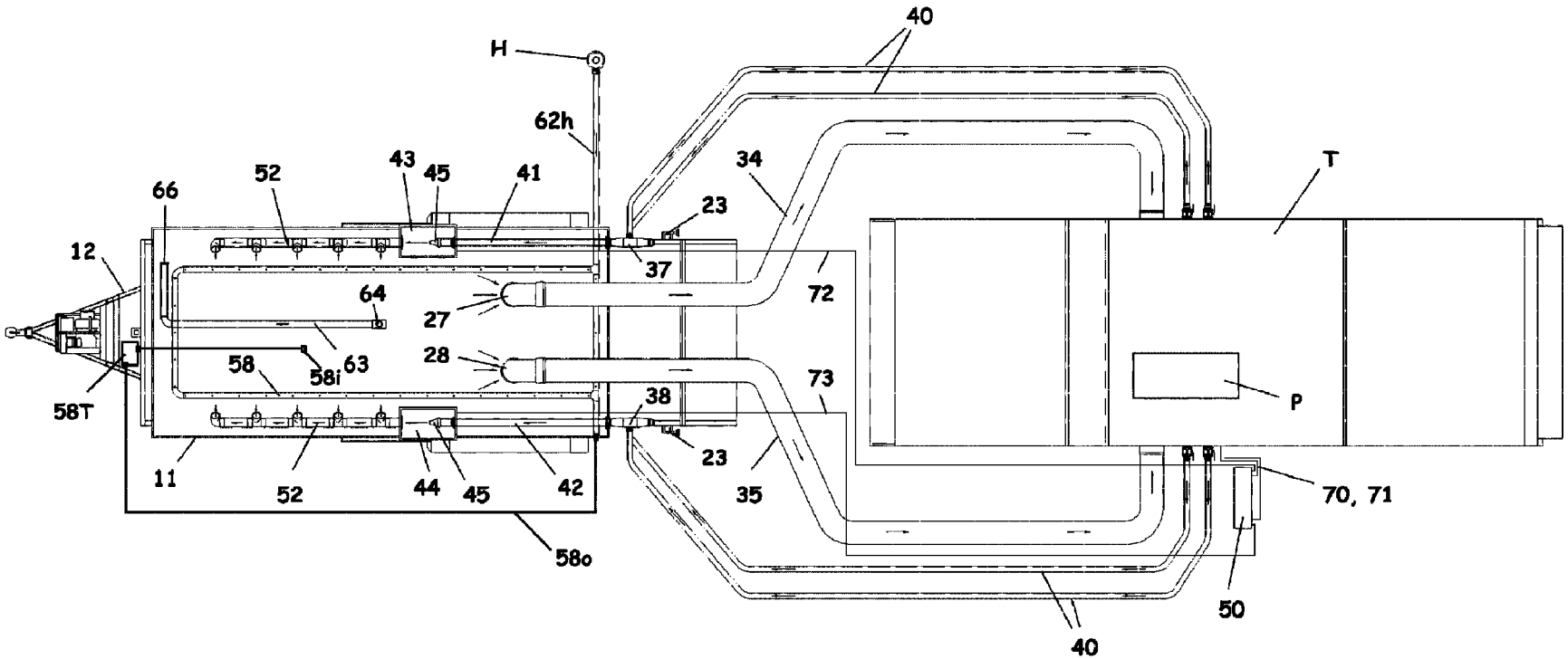
FIG. 9 is a plan view of the mobile pump testing apparatus of the present invention connected to a fire fighting vehicle for testing the pumping capacity of the pump(s) onboard the vehicle.

A central monitoring station 50 is provided to receive and display the various measurements taken during the pump testing procedures. The monitoring station 50 is carried on a rear portion of the trailer 12 during transport to the testing site, and is removable from the trailer 12 and portable to allow multiple setup configurations during pump testing. For example, the monitoring station 50 can be removed from the trailer 12 and positioned beside the fire fighting equipment T, as shown in FIG. 9.

The monitoring station 50 houses a master pump pressure gauge 67, a master vacuum gauge 68, and right and left pitot gauges 48, 49. The monitoring station 50 is completely portable and can be positioned on or near midship, top mount, rear mount, and front mount pumps of fire fighting equipment T. For example, the monitoring station 50 can be mounted to a heavy duty aluminum extendable tripod 69.

The master pump pressure gauge 67 provides a first gauge for measuring the pressure on an outlet side of a pump P being tested. The master vacuum gauge 68 provides a second gauge for measuring the vacuum on an inlet side of the pump P being tested. The right and left pitot gauges 48, 49 provide third and fourth gauges for measuring the flow rates of the water being pumped into the respective flow stations 43, 44.

The first and second gauges 67, 68 are connected by hoses 70, 71 to the pressure and vacuum measuring ports on the pump P being tested, while the third and fourth gauges 48, 49 are connected by lines 72, 73 to the pitot meters 46, 47 at the respective flow stations 43, 44. In an alternative embodiment, electronic transducers can be used to measure the vacuum, pressure and flow rates, and electric wires can be used to communicate the results of the measurements to electronic displays at the monitoring station 50.

A vented compartment 74 is located at the rear of the apparatus 10 to carry hoses, tools, adaptors, and the like.

In use, the pump testing apparatus 10 is transported by the trailer 12 to the testing site, located on a level surface, and stabilized in position by lowering the stabilizing jacks 23 to relieve weight from the transporter axles of the trailer 12. The tank 11 is then filled with water, for example, by connecting a fill hose 62*h* between a hydrant 62 (or a tanker) and one of the inlet ports on the apparatus, such as the cooling system inlet ports 60, 61. The hydrant 62 (or other water source) and valve 75 associated with the inlet port 60, 61 are then opened to fill the tank 11. The tank 11 can also be filled by connecting a hydrant 62 or other water source to one of the inlet manifolds 37, 38 or by flowing water into another opening on the top side 15 of the tank 11.

The fire fighting equipment T containing a pump P to be tested, such as a fire fighting vehicle, is then parked next to the testing apparatus 10. A series of checks are performed on the pump P to be tested, such as checking for proper fluid levels, and the results of the checks are recorded on a pump test form. A no load test is performed to determine if the engine or other power supply for driving the pump P has sufficient power. A dry vacuum test is performed using the vacuum gauge 68 on the monitoring station 50 to measure the amount of vacuum produced by the pump primer to determine if it has enough vacuum to pull water through the draft tubes 27, 28 and the suction hoses 34, 35 to supply the pump P. The results of these preliminary tests are recorded on the pump test form.

One or both of the suction hoses 34, 35 connected to the draft tubes 27, 28 are moved to a desired angular position and are connected to the suction hose(s) of the pump P to be tested. The discharge line(s) of the pump P are connected by hoses 40 to an inlet port or ports 39 on one or both of the inlet manifolds 37, 38 on the testing apparatus 10.

The restriction nozzle tips 45 in the flow stations 43, 44 are checked, and changed if necessary, to provide an appropriate flow restriction to match the particular parameters of the test to be performed. For example, a smaller nozzle tip can be used to increase the line pressure and reduce the flow at a given pump speed, while a larger nozzle tip can be used to reduce the line pressure and increase the flow.

The monitoring station 50 is removed from the trailer 12 and placed at a convenient location for monitoring and recording the test results. The lines 72, 73 from the flow rate gauges 48, 49 at the monitoring station 50 are connected to the first and second pitot meters 46, 47 in the flow stations 43, 44. The pressure line 70 is connected between the pressure gauge 67 and a discharge side of the pump P of the equipment T to measure the pressure in the pump. The suction line 71 is connected between the vacuum gauge 68 and the inlet side of the pump P to measure vacuum in the pump.

The pump P is then operated to draw water out of the tank 11 through the draft tubes 27, 28, and to discharge water back into the tank 11 through the inlet manifold(s) 37, 38. A series of different pump tests can be run by changing the restriction nozzle tips 45 at the ends of the main water lines 41, 42 in the flow stations 43, 44 and adjusting the pump speed. For example, a first test can be run with a first nozzle tip and pump speed that allows the pump P to operate at 100% of its rated capacity at 150 psi pressure, a second test can be run with a second nozzle tip and pump speed that allows the pump P to operate at 70% of its capacity at 200 psi, and a third test can be run with a third nozzle tip and pump speed that allows the pump P to operate at 50% of its capacity at 250 psi.

In a typical procedure, the pump P is run at 100% rated capacity for 20 minutes, followed by a 10% overload test for 5 minutes. The restriction nozzle tip 45 is then changed and the pump P is run at 70% of rated capacity for 10 minutes. The restriction nozzle tip 45 is then changed again, and the pump P is run at 50% of rated capacity for 10 minutes. The pump test data is logged at predetermined intervals, such as every 5 minutes, until the test is completed.

During the testing procedures, the temperature of the circulating water will usually increase over time. The temperature increase is caused by the water turbulence and friction as the water moves through the apparatus and the tested equipment, and by the ambient temperature of the outside air being higher than the water temperature. Pump performance can be affected by water temperature, and standard pumping procedures require the water being pumped to be maintained below a predetermined maximum temperature (e.g., 80 degrees F.). Therefore, the water temperature must be monitored during the pump tests, and the cooling system 58 is used when necessary to keep the water temperature below the maximum allowed temperature.

Once the test is underway and the tank water temperature starts to rise, the valve 74 at the cooling water inlet port 60, 61 is partially opened to allow fresh cool water to enter the tank through the cool water outlets 62 at spaced locations near the bottom of the tank 11. The cool water enters the tank 11 near the bottom 13 of the tank 11, which is also where the draft tubes 27, 28 pick up water to supply to the pump P being tested. The warmer water naturally moves to the top of the tank 11 and is purged from the tank 11 through the overflow system 63 at the top of the tank 11.

When the test is completed, the apparatus 10 can be unhooked from the pump P being tested, and hooked up to another pump to be tested at the same location. When all tests have been completed at the location, the tank 11 can be drained, the stabilizing jacks 23 raised, and the hoses 34, 35 and monitoring station 50 reloaded onto the trailer 12 for transport to another location.

While the invention has been specifically described in connection with specific embodiments thereof, it is to be understood that this is by way of illustration and not of limitation, and the scope of the appended claims should be construed as broadly as the prior art will permit.

What is claimed is:

1. A pump testing apparatus, 1 comprising:

a tank;

at least one tank outlet associated with the tank for drawing a test fluid out of the tank for pumping by a pump being tested;

at least one tank inlet associated with the tank for receiving the test fluid pumped by the pump being tested;

a baffle system in the tank for removing cavitations from the test fluid circulating within the tank between said tank inlet and said tank outlet during pump testing;

a cooling system that cools the test fluid within the tank to maintain a desired fluid temperature of the test fluid during pump testing; and said cooling system comprises a means for introducing a supply of cool water throughout the tank.

2. The pump testing apparatus according to claim 1, wherein said cooling system comprises a supply line having a cool water inlet for connecting to a source of cool water, and a plurality of cool water outlets at spaced locations throughout the tank for introducing a supply of cool water into the tank.

3. The pump testing apparatus according to claim 2, wherein said plurality of cool water outlets are located in a lower part of the tank so that the cool water mixes with the test fluid in a lower part of the tank.

4. The pump testing apparatus according to claim 3, further comprising an overflow system connected to an upper part of the tank for purging warm water from the tank when fresh cool water is introduced into the lower part of the tank by the cooling system.

5. The pump testing apparatus according to claim 1, wherein said at least one tank outlet comprises at least one draft tube that passes through a top side of the tank and has an open lower end near a bottom of the tank for drawing water out of the lower part of the tank.

6. The pump testing apparatus according to claim 5, wherein said draft tube has a vertical portion that extends into the tank and a horizontal portion connected to the vertical portion by an elbow structure, said draft tube being rotatable about a vertical axis to change the direction of the horizontal portion to facilitate connecting the tank outlet to a pump to be tested.

7. The pump testing apparatus according to claim 1, wherein said at least one tank outlet comprises two draft tubes extending through a top side of the tank with open lower ends near a bottom of the tank for drawing water out of the lower part of the tank at two different spaced apart locations.

8. The pump testing apparatus according to claim 7, wherein both of said draft tubes are mounted to swivel relative to the tank to facilitate connecting the draft tubes to a pump to be tested.

9. The pump testing apparatus according to claim 1, wherein said at least one tank inlet comprises a flow station with a flow measuring device for measuring an output of a pump being tested.

10. The pump testing apparatus according to claim 9, further comprising a discharge line associated with said flow station, said discharge line having multiple openings spaced throughout the tank for discharging water from the flow station into the tank.

11. The pump testing apparatus according to claim 9, wherein said flow measuring device comprises a nozzle and a pitot meter.

12. The pump testing apparatus according to claim 1, wherein said at least one tank inlet comprises a first tank inlet on a first side of the tank and a second tank inlet on a second side of the tank, and wherein each of said first and second tank inlets comprises a flow station with a flow measuring device for measuring an output of a pump being tested.

13. The pump testing apparatus according to claim 1, wherein said at least one tank inlet comprises a manifold having a plurality of inlet ports for connecting with a plurality of pump discharge lines from a pump being tested, said manifold being arranged to combine fluid received from said inlet ports for common discharge into a flow station having a flow measuring device for measuring an output of the pump being tested.

14. The pump testing apparatus according to claim 1, further comprising a monitoring station having at least a first gauge for measuring vacuum on an inlet side of a pump being tested, a second gauge for measuring pressure on an outlet side of the pump being tested, and a third gauge for measuring flow rate of the test fluid being pumped.

15. The pump testing apparatus according to claim 14, wherein said monitoring station and said tank are mounted on a mobile trailer to facilitate transporting the apparatus to a test site, and said monitoring station is removable from the mobile trailer to allow multiple setup configurations during pump testing.

16. The pump testing apparatus according to claim 1, wherein said tank is mounted on a mobile trailer to facilitate transporting the apparatus to a test site.

17. The pump testing apparatus according to claim 1, wherein said baffle system comprises a plurality of compartments and openings provided between adjacent compartments to allow test fluid to circulate within the tank from one compartment to another during pump testing to reduce cavitation.

18. The pump testing apparatus according to claim 17, wherein said plurality of compartments are defined by vertical walls located within the tank, and wherein said openings comprise a first plurality of openings that allow water to flow under the vertical walls between the compartments, a second plurality of openings that allow water to flow through a lower portion of the vertical walls between the compartments, and a third plurality of openings that allow purged air to pass through an upper portion of the vertical walls.

19. The pump testing apparatus according to claim 18, wherein said plurality of compartments comprises a first group of compartments located around an outer area of the tank and a second group of compartments located at an inner area of the tank, and wherein said first group of compartments have their top sides closed and said second group of compartments have their top sides open.

20. The pump testing apparatus according to claim 1, wherein said test fluid is water, and wherein said pump to be tested is associated with fire fighting equipment.

21. The pump testing apparatus according to claim 20, wherein said tank is constructed to accommodate a water flow rate within a range of 500 to 3,000 gallons per minute through said at least one tank outlet and said at least one tank inlet.

22. A method of testing a pump associated with fire fighting equipment, comprising:

providing a tank containing a supply of water;

connecting at least one suction hose between the fire fighting equipment and a draft tube that extends into a lower part of the tank;

connecting at least one discharge line between the fire fighting equipment and an inlet manifold associated with the tank;

operating the pump to draw water from the lower part of the tank through the suction hose and to discharge water back into the tank through the inlet manifold;

measuring a flow rate of water passing through the inlet manifold into the tank;

using a baffle system to deflect the water circulating in the tank to prevent cavitation between where the water enters the tank from the inlet manifold and where the water exits the tank through the draft tube; and cooling the water in the tank while operating the pump to maintain a desired water temperature during a pump testing procedure, said cooling comprising connecting a source of fresh water to a cooling system associated with the tank, and injecting fresh water into a lower part of the tank through a plurality of ports located throughout the tank.

23. The method of testing a pump according to claim 22, further comprising purging warm water from an upper part of the tank through an overflow system.

24. The method of testing a pump according to claim 22, wherein said step of connecting at least one suction hose comprises connecting two suction hoses between the fire fighting equipment and respective draft tubes extending into lower parts of the tank, and wherein said step of connecting at least one discharge line comprises connecting a plurality of discharge lines between the fire fighting equipment and the inlet manifold.

25. The method of testing a pump according to claim 22, further comprising measuring a vacuum on an inlet side of the pump, and measuring a pressure on a discharge side of the pump.

26. A pump testing apparatus, comprising:

a tank;

at least one tank outlet associated with the tank for drawing a test fluid out of the tank for pumping by a pump being tested;

at least one tank inlet associated with the tank for receiving the test fluid pumped by the pump being tested;

a baffle system in the tank for removing cavitations from the test fluid circulating within the tank between said tank inlet and said tank outlet during pump testing; and a cooling system that cools the test fluid within the tank to maintain a desired fluid temperature of the test fluid during pump testing, said cooling system comprising a heat exchanger or cooling tower that uses a cooling cycle for removing heat from the circulating water during pump testing.

27. A method of testing a pump associated with fire fighting equipment, comprising:

providing a tank containing a supply of water;

connecting at least one suction hose between the fire fighting equipment and a draft tube that extends into a lower part of the tank;

connecting at least one discharge line between the fire fighting equipment and an inlet manifold associated with the tank;

operating the pump to draw water from the lower part of the tank through the suction hose and to discharge water back into the tank through the inlet manifold;

measuring a flow rate of water passing through the inlet manifold into the tank;

using a baffle system to deflect the water circulating in the tank to prevent cavitation between where the water enters the tank from the inlet manifold and where the water exits the tank through the draft tube; and cooling the water in the tank while operating the pump to maintain a desired water temperature during a pump testing procedure, said cooling comprising using a heat exchanger or cooling tower that uses a cooling cycle to remove heat from the circulating water during a pump testing procedure.

* * * * *